US007628350B2

(12) United States Patent
Dethier

(10) Patent No.: US 7,628,350 B2
(45) Date of Patent: Dec. 8, 2009

(54) DEVICE FOR WINDING AND UNWINDING OF HOSES, CABLES OR THE LIKE

(76) Inventor: Livin Fernand Georges Dethier, Leemkuilstraat 144, 3570 Alken (BE)

( * ) Notice: Subject to any disclaimer, the term of this patent is extended or adjusted under 35 U.S.C. 154(b) by 312 days.

(21) Appl. No.: 11/579,808

(22) PCT Filed: May 3, 2005

(86) PCT No.: PCT/BE2005/000067

§ 371 (c)(1),
(2), (4) Date: Nov. 7, 2006

(87) PCT Pub. No.: WO2005/108268

PCT Pub. Date: Nov. 17, 2005

(65) Prior Publication Data

US 2008/0029639 A1 Feb. 7, 2008

(30) Foreign Application Priority Data

May 10, 2004 (BE) ..... 2004/0228

(51) Int. Cl.
*B65H 75/40* (2006.01)

(52) U.S. Cl. ..... 242/403; 242/533.8; 242/557

(58) Field of Classification Search ..... 242/403.1, 242/403, 533.8, 557
See application file for complete search history.

(56) References Cited

U.S. PATENT DOCUMENTS 611,767 A 10/1898 Bossow
2,956,762 A 10/1960 Alston
3,072,357 A * 1/1963 Sprague et al. ..... 242/594.3
3,134,555 A * 5/1964 Baker ..... 242/594.3
3,856,230 A * 12/1974 Zimmer ..... 242/422.8
4,687,154 A 8/1987 Deweese
4,723,568 A 2/1988 Adams
5,265,815 A 11/1993 Soyka et al.
5,509,671 A * 4/1996 Campbell ..... 280/47.19
6,422,581 B1 7/2002 Gebell et al.
6,698,682 B1 * 3/2004 Roderick ..... 242/557
7,461,809 B1 * 12/2008 Maley ..... 242/557

FOREIGN PATENT DOCUMENTS

| | | |
|---|---|---|
| AU | 74090 81 | 2/1983 |
| AU | 690 511 | 4/1998 |
| DE | 398 026 | 7/1924 |
| DE | 2 029 198 | 12/1971 |
| DE | 202 03 887 | 7/2003 |
| GB | 537 426 | 6/1941 |
| JP | 8-81137 | 3/1996 |

* cited by examiner

*Primary Examiner*—Sang Kim
(74) *Attorney, Agent, or Firm*—Bacon & Thomas, PLLC

(57) ABSTRACT

Device for winding and unwinding hoses, cables or the like, which device (1) mainly consists of a wheeled undercarriage (2) with a support (6), whereby suspension means (9) are provided on the above-mentioned support (6) in the shape of at least two fixed guides (10 and 11), which are each made in the shape of a bent element (12), and whereby these bent elements (12) are directed with their hollow sides towards each other, whereby the above-mentioned bent elements (12) are confined by at least one upward or downward directed partition (13) which is practically parallel to the support (6) and whereby intermediate partitions (14) are provided on these elements (12) as well.

9 Claims, 7 Drawing Sheets

DEVICE FOR WINDING AND UNWINDING OF HOSES, CABLES OR THE LIKE

BACKGROUND OF THE INVENTION

A. Field

The present invention concerns a device for winding and unwinding hoses, cables or the like.

B. Related Art

On construction sites or the like it is often found, in practice, that elongated flexible materials such as hoses, cables and the like are often left lying about on the ground, which entails a considerable risk of people tripping over them. It is also found that gathering loose, often very heavy hoses or cables is difficult and puts a heavy load on the back.

Devices in the form of what are called reels are already known, which mainly consist of a wheeled undercarriage, onto which is provided a rotatable drum for winding and unwinding a garden hose or the like.

A disadvantage of such known reels is that they are relatively sizeable due to the presence of the above-mentioned drum and that the construction of such reels is relatively complex, as a result of which the assembly thereof takes much time.

Another disadvantage of such known reels is that they are not fit for winding very long and/or thick hoses or the like, since the dimensions of the above-mentioned drum are very large then, as a result of which such reels are then unmanageably large and heavy and are difficult to put away.

Another disadvantage of such known reels is that relatively much material is required to manufacture such drums, as a result of which the cost price of such reels is relatively high.

An additional disadvantage of the known reels is that, if the above-mentioned drum is small, electric cables and the like, after having been unwound, still have loops, which is inconvenient and which may result in knots.

Another additional disadvantage of the known wheeled reels is that the hose or cable must lie straight in order to be able to wind it properly and to avoid that the hose or cable becomes entangled.

Another disadvantage of the known reels for electric cables is that, while in use, when a considerable amount of the cable is still wound on the drum, this cable may become very hot, since the part of the cable which is wound against the drum, cannot give off sufficient heat to the environment, as a result of which the cable or the reel may be damaged due to overheating.

Another disadvantage of the known reels is that they are provided with moving parts which are liable to wear.

The present invention aims to provide a solution to one or several of the above-mentioned and other disadvantages.

BRIEF SUMMARY OF THE DISCLOSURE

To this end, the invention concerns a device for winding and unwinding hoses, cables or the like, which device mainly consists of a wheeled undercarriage or carrier upon which is provided an upward directed support, whereby suspension means are provided on the above-mentioned support in the shape of at least two fixed guides, which are each made in the shape of a bent element, and whereby these bent elements are directed with their hollow sides towards each other (or their convex sides facing away from each other) and are provided at a distance from each other on the support, and can support the above-mentioned hoses and/or cables in at least two places situated at a distance from each other, whereby the above-mentioned bent elements are confined by one or two upward or downward directed partitions which are parallel, or almost parallel to the support, and whereby also intermediate partitions are provided on these elements.

An advantage thereof is that a device is obtained whose construction is very simple and compact and which can be quickly assembled.

Another advantage of such a device according to the invention is that it is extremely suitable for winding very long cables, since the dimensions of the suspension means can be restricted, as a result of which such a device according to the present invention is easy to handle and light, and as a result of which such a device can be easily stored.

Another advantage of such a device according to the present invention is that, for manufacturing such suspension means, little material is required, as a result of which the cost price of such a device according to the invention is low.

An additional advantage is that electric cables and the like can be wound over a larger girth, such that, after having been unwound, they will not show any loops, and as a result of which the risk of hindrance caused by knots or the like decreases.

Another additional advantage of a device for winding and unwinding hoses, cables or the like, is that the hose or cable must not lie straight in order to be able to wind it properly, as the hose or cable can be wound up manually.

Another advantage is that, with a device according to the present invention, also very heavy cables and/or hoses can be wound in a simple manner.

Another additional advantage of such a device according to the invention is that the hoses or the like which are wound with such a device can be pulled taut around the top and bottom guide, as a result of which the hoses or the like can be wound in a very compact manner, and space can be saved widthwise in relation to the known devices with a drum.

Thanks to the presence of the partitions, cables, hoses and the like can be stored in a fixed manner, such that falling off and lying about can be avoided and the risk of entanglements decreases.

By means of the above-mentioned intermediate partitions, also several cables or the like can be wound on a device according to the invention, whereby, if necessary, a partition can be provided between different cables.

The present invention also concerns a device for winding and unwinding hoses, cables or the like, which device mainly consists of a wheeled undercarriage upon which is provided an upward directed support, whereby suspension means are provided on the above-mentioned support in the shape of at least two guides, which are each made in the shape of an element and whereby these elements are provided at a distance from each other on the support, and can support the above-mentioned hoses and/or cables in at least two places situated at a distance from each other, having as a special characteristic that the above-mentioned elements are confined by one or two partitions which are parallel or almost parallel to the support, and that also intermediate partitions are provided on these elements.

Thanks to the presence of the partitions, cables, hoses and the like can be stored in a fixed manner with such a device as well, such that falling off and lying about is avoided and the risk of entanglements decreases.

By means of the above-mentioned intermediate partitions, also several cables or the like can be wound on a device according to the invention, whereby, if necessary, a partition can be provided between different cables.

Such a device also has a very simple and compact construction, and it can be quickly assembled.

By making the above-mentioned guides rotatable, for example, a hose, cable or the like can be wound in a simple manner.

DESCRIPTION OF THE DRAWINGS

In order to better explain the characteristics of the invention, the following preferred embodiments of a device according to the invention for winding and unwinding hoses, cables or the like, are given as an example only without being limitative in any way, with reference to the accompanying drawings, in which.

DETAILED DESCRIPTION OF PREFERRED EMBODIMENTS OF THE INVENTION

Figure 1:
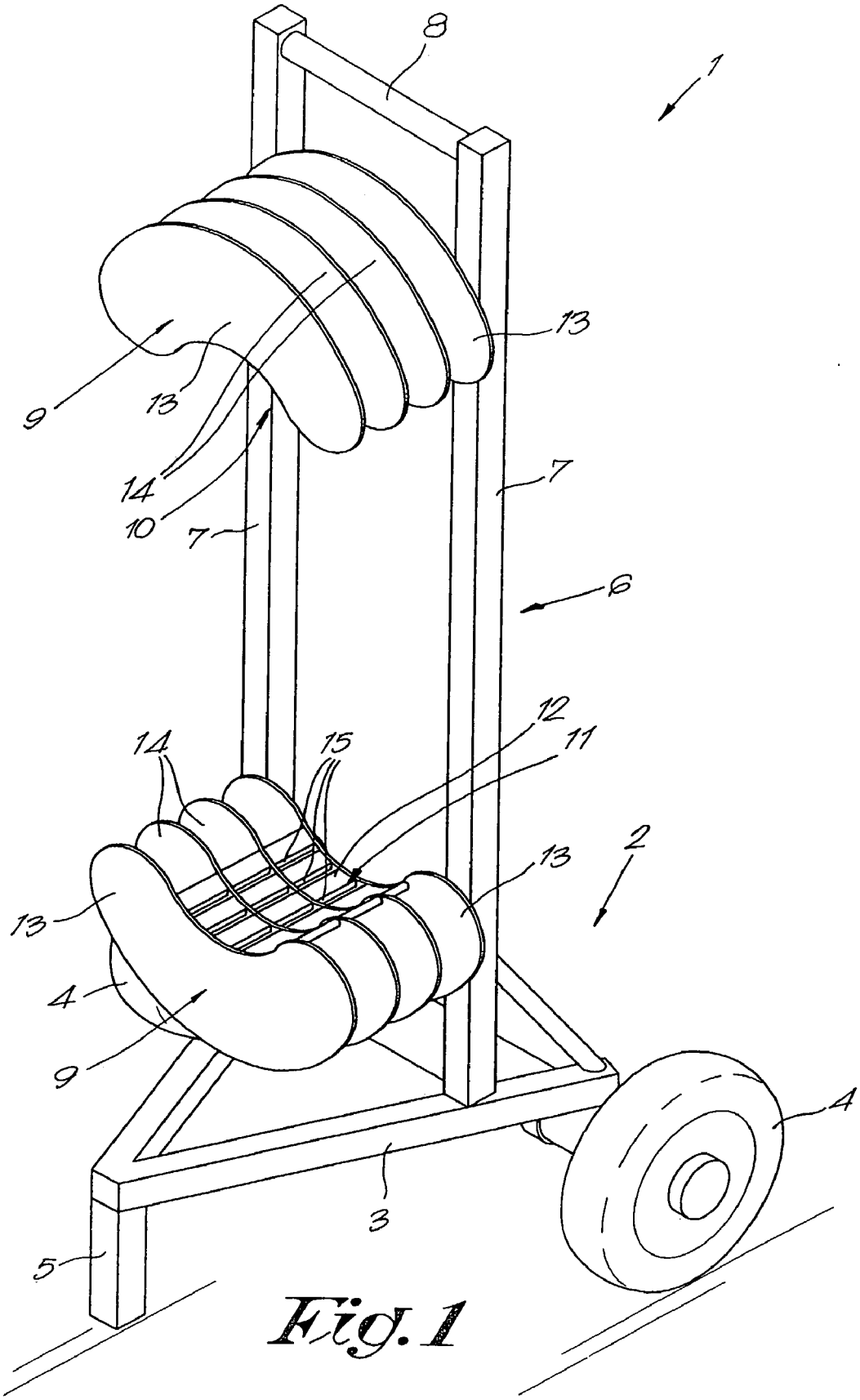
FIG. 1 schematically represents a device according to the invention in perspective.

FIG. 1 represents a device 1 according to the invention which mainly consists of an undercarriage 2 which is built up of a base 3 upon which are provided, in this case, two wheels 4 and a supporting leg 5.

On the above-mentioned base 3 is also provided an upward directed elongated carrier or support 6, in this case of two pipes or support elements 7 running parallel which are connected at their free ends by means of a connecting rod 8, which in this case also forms a handle. The pipes 7, as illustrated, be in a common plane that includes both pipes.

On the above-mentioned support 6 are provided suspension means 9, one on top of the other, between the above-mentioned pipes 7, in the shape of an upper fixed guide 10 and a lower fixed guide 11.

It is clear that the above-mentioned suspension means 9 can also be provided on the above-mentioned, support 6 such that they can be removed and put back.

Each of the above-mentioned guides 10-11 consists in this case of a convex curved bent element 12 which is confined by two upward, two downward directed partitions 13 respectively, which are parallel or practically parallel to the support 6. The bent elements 12 form bottom sides of the guides 10, 11, with the convex sides facing away from each other and towards the opposite ends of the carrier or support 6.

Between the above-mentioned partitions 13 are also provided intermediate partitions 14 according to the invention, which can preferably but not necessarily be provided at variable intermediate distances on the above-mentioned guides 10-11 by means of adjusting means which are not represented in the figures, but which are known as such.

The above-mentioned partitions 13 and/or intermediate partitions 14 can preferably be removed and put back on the above-mentioned guides 10-11, for example by means of a snap-in connection or the like.

The above-mentioned bent elements 12 extend traversely on the above-mentioned support 6, and the hollow sides of these bent elements 12 are directed towards each other.

In the bent elements 12 are also provided one or several recesses 15. It is clear that such recesses 15 can also be provided in the above-mentioned partitions 13.

The combined bent elements 12 and partitions 13 may be referred to herein as "suspension elements."

Figure 2:
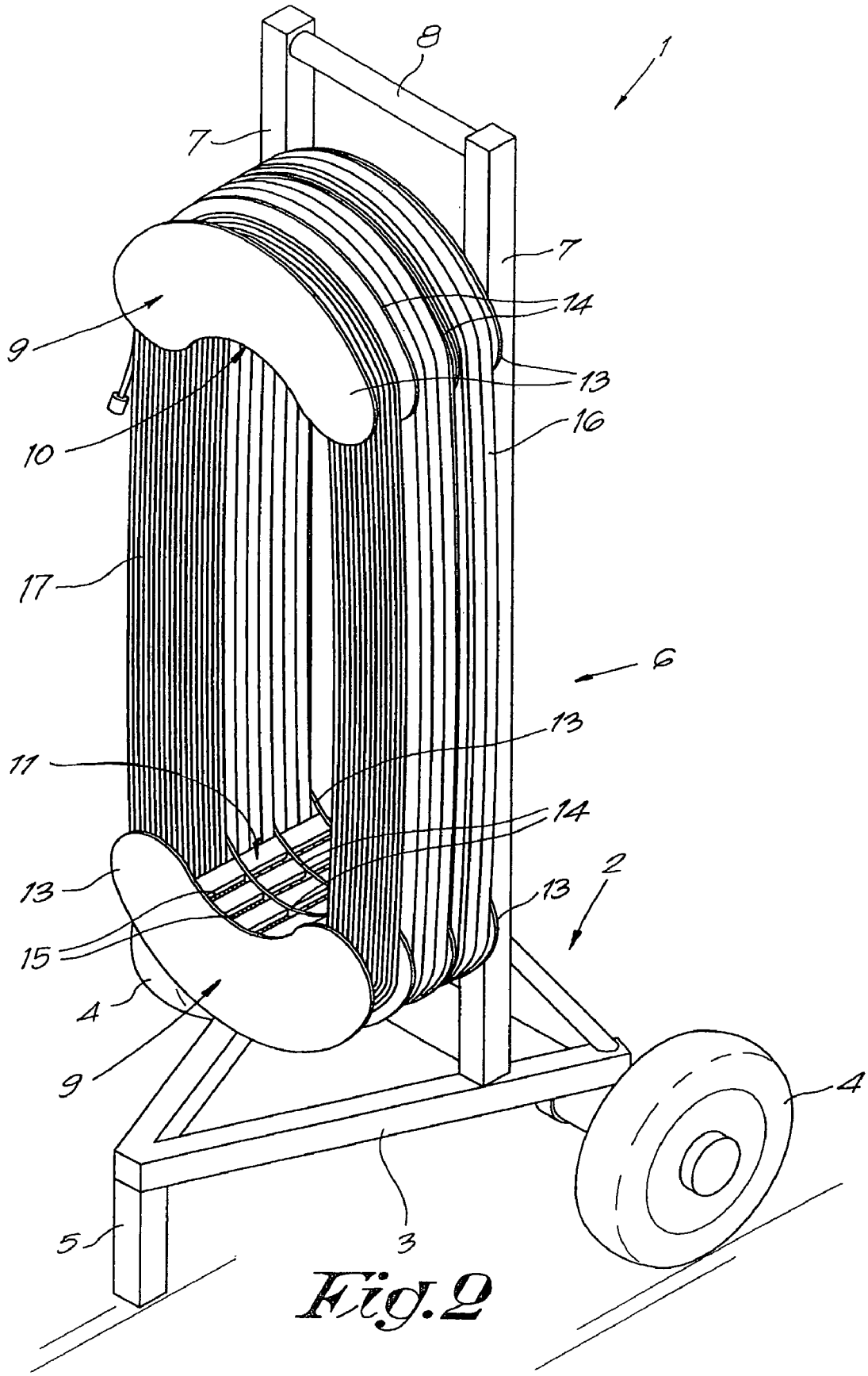
FIG. 2 represents the use of a device according to FIG. 1.

The use of such a device according to the invention is very simple and is represented in FIG. 2.

For winding and unwinding a hose 16 or the like on the device 1, the hose 16 must be wound manually over the above-mentioned upper and lower guides 10-11, whereby the above-mentioned partitions 13 make sure that the hose 16 is retained on the guides 10-11.

If different cables, hoses or the like must be wound on the device 1, they can be kept apart by means of the above-mentioned intermediate partitions 14, as represented in the figure, whereby a cable 17 is wound separately around the guides 10-11.

If necessary, it is also possible, according to the invention, to remove one or several of the above-mentioned intermediate partitions 14, for example, or to adjust the mutual distance between the respective intermediate partitions 14.

For winding and unwinding very long cables 17 or the like, the device 1 according to the invention can be wheeled, making use of the connecting rod 8 forming a handle, whereby the device 1 is kept slantingly backward, such that the above-mentioned supporting leg 5 is lifted. The above-mentioned device 1 can hereby be moved along the trajectory of the unwound cable 17 or the like, while the cable 17 is wound or unwound manually around the above-mentioned guides 10-11.

The recesses 14 in the above-mentioned bent elements 9 make it possible for dirt and the like, sticking to a cable 17 or hose 16 to be wound, to drop through said recesses 14. Said recesses 14 also make sure that heat of for example electric cables 17 can be easily given off to the environment.

Figure 3:
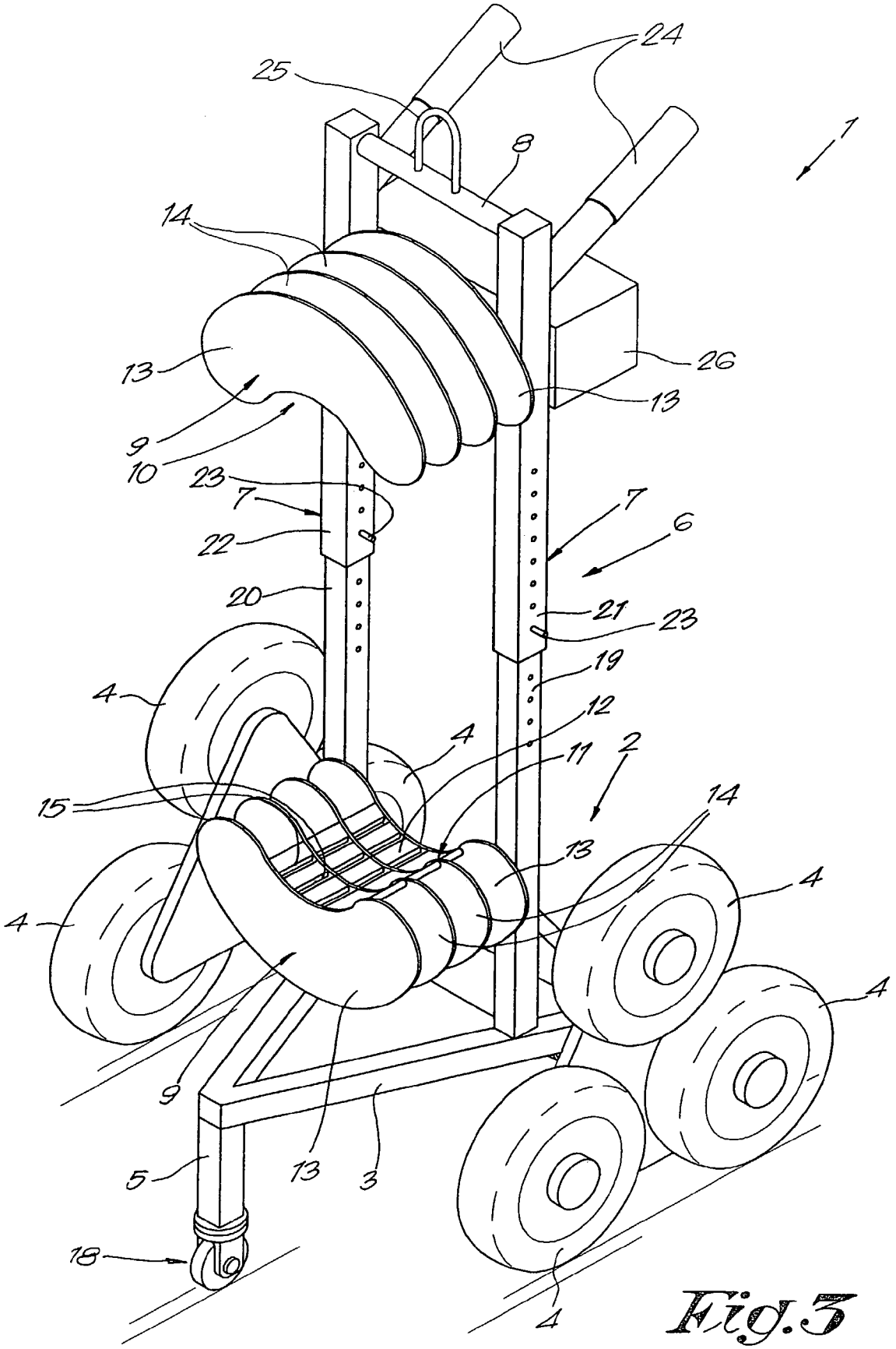
FIGS. 3 to 5 represent variants of a device according to FIG. 1, whereby the variant of FIG. 5 is represented in another position.

FIG. 3 represents a variant of a device 1 for winding and unwinding hoses 16 and the like according to the invention.

This variant differs from a device according to FIG. 1 in that the above-mentioned wheels 4 are made in the form of what are called step wheels which are each formed of three wheels respectively provided in a triangular bracing on a plate which is fixed to the base 3 in a rotatable manner. The above-mentioned supporting leg 5 has been replaced by a swivel castor 18.

The above-mentioned support 6 is hereby made telescopic, as it is formed of lower pipes 19-20 over which two upper pipes 21-22 are provided in a sliding manner. On the above-mentioned support 6 are also provided locking means 23.

This embodiment is also provided with handles 24 which are provided on each of the above-mentioned upper pipes 21-22 and which extend slantingly in relation to the above-mentioned support 6.

On the above-mentioned connecting rod 8 is provided a crane hook 25, for example in the shape of a metal ring or the like.

At the height of the upper guide 10 of the suspension means 9 are provided connecting means 26 for one or several hoses 16, cables 17 or the like, which connecting means 26 are preferably made such that they can be removed and placed back.

The use of such a variant embodiment is analogous to the one described above, but such a variant of a device 1 according to the invention can also be moved over stairs, steps and the like, by means of the above-mentioned step wheels.

Thanks to the presence of the swivel castor 18, such a variant device 1 according to the invention is more manoeuvrable than the preceding embodiment.

The above-mentioned upper guide 10 is hereby adjustable in height, thanks to the pipes 19-20-21-22 which are adjustable in height, such that the device 1 can be made suitable for cables 17 with different lengths and diameters, by adjusting the mutual distance between the guides 10-11.

In the known manner, the above-mentioned connecting means are made in the shape of a distributing board or a combination of two or several distributing boards for, for example, electric, pneumatic and/or hydraulic connections, and if necessary they can be removed and/or replaced by other connecting means 26, such that a modular system is formed which can be used for several applications, such as, for example, for high-voltage and low-voltage applications.

By means of the above-mentioned crane hook 25, the device 1 according to the invention can be lifted in the known manner by means of a crane or the like.

Figure 4:
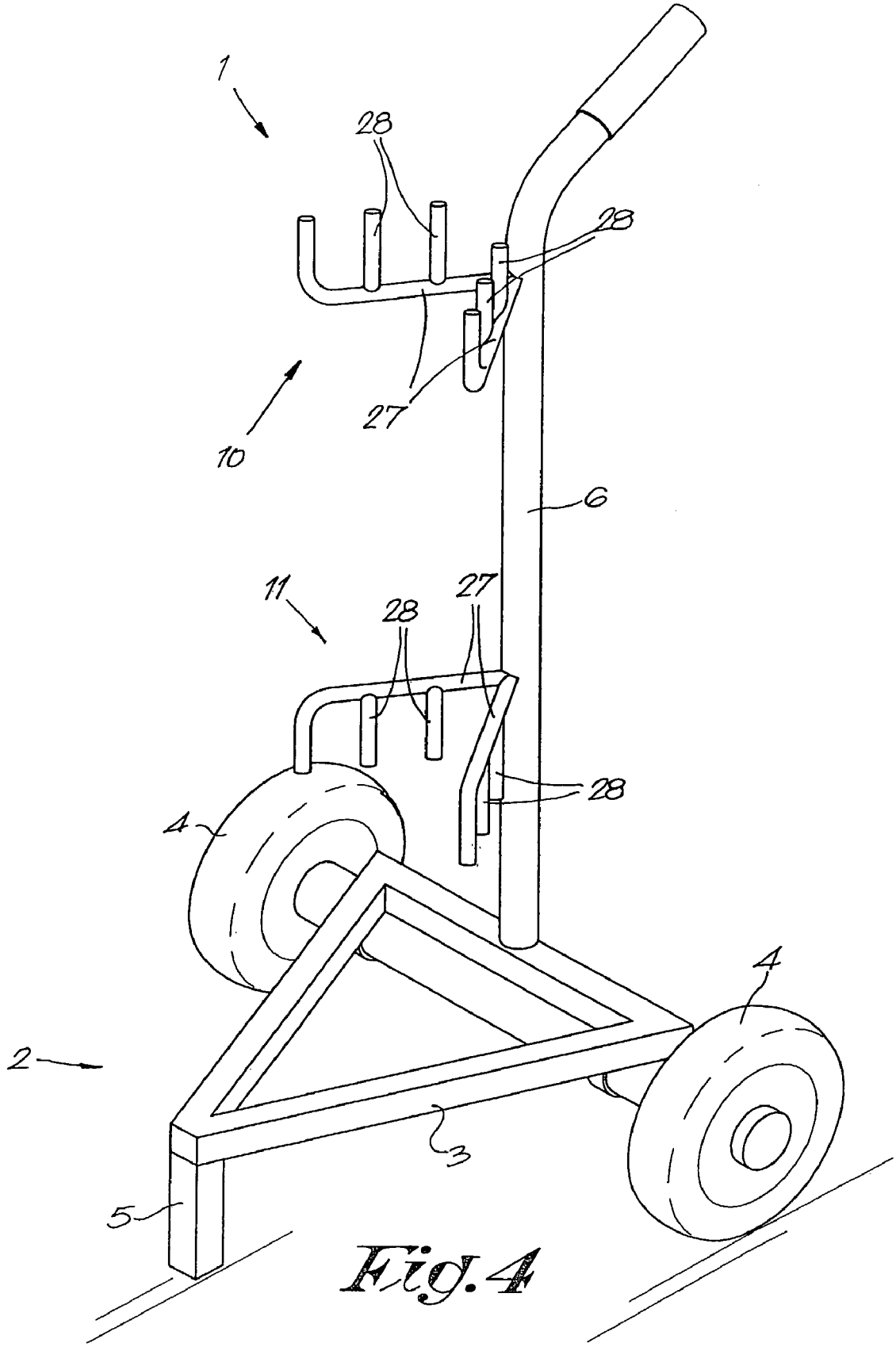

FIG. 4 represents another variant of a device 1 according to the invention, whereby the above-mentioned support 6 is made in the shape of a single central standing pipe, upon which guides 10-11 are provided which for example each consist of two pairs of hooks 27 which are placed on top of each other, and whereby the lower pair of hooks and the upper pair of hooks are directed away from each other.

The advantage thereof is that a relatively wide guide can be obtained with very little material, as a result of which such a device 1 according to the invention is cheap, and whereby it is nevertheless avoided that hoses or the like are locally squeezed due to too sharp bends in the wound hose at the height of the suspension means 9.

In this case, intermediate hooks 28 which can be either or not removed and placed back and/or which are adjustable are also provided on the above-mentioned hooks 27, as a result of which cables, hoses or the like can be wound on this device 1.

It goes without saying that, if required, partitions 13 and/or intermediate partitions 14 which can be either or not removed and placed back can be provided on said hooks 27.

The use of such a variant of a device 1 according to the invention is analogous to the above-described embodiments.

Figure 5:
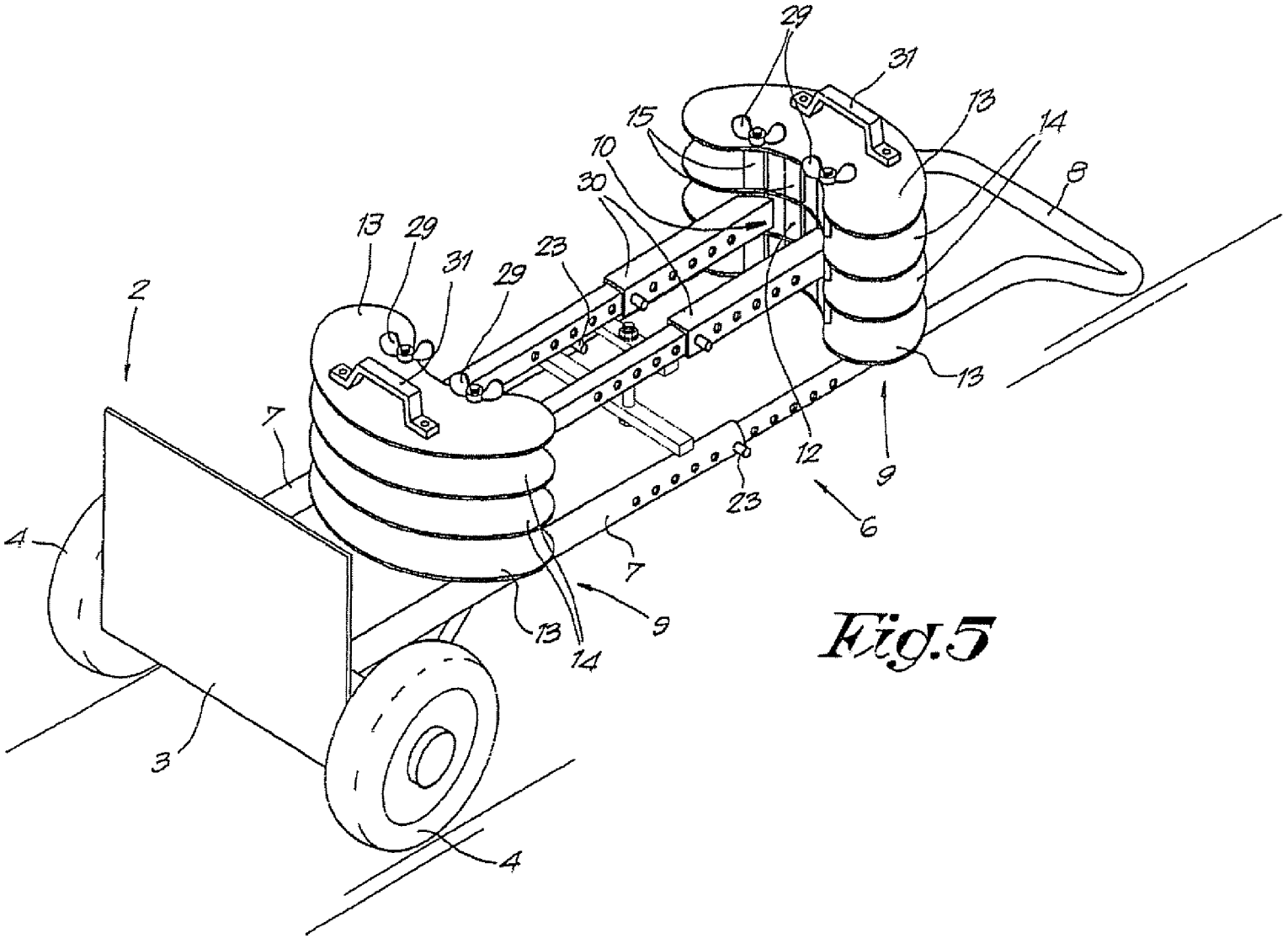

FIG. 5 represents another variant of a device 1 according to the invention.

The handle of this variant device 1 is formed of a connecting rod 8, whereby the top part of the support 6 is bent, such that when the device 1 is laid flat, the above-mentioned handle forms a point of support on the ground, which makes the winding and unwinding of the hoses 16, cables 17 or the like easier.

The front partitions 13, and if necessary also the intermediate partitions 14, can in this case be removed and placed back on the above-mentioned bent elements 12, by means of wing nuts 29.

It is clear that numerous other fastening manners are possible for these partitions 13 and for the intermediate partitions 14, such as for example an ordinary bolt connection, a clip connection, or the like.

The above-mentioned guides 10-11 are in this case connected to each other by means of two rods 30 forming an elongated frame which are connected to these guides 10-11 in an either or not easily removable manner and which are telescopically adjustable in this case to vary the distance between the guides 10-11.

The guides 10-11 can also be removed from the above-mentioned support 6. To this end, a handle 31 is provided on two of the partitions 13 as well in this case.

It is clear that the presence of this handle 31 according to the invention is not strictly required, and that it can also be provided on one or several of the above-mentioned guides 10-11 or on intermediate partitions 14.

In this case, the above-mentioned base 3 is made in the shape of a flat supporting plate which can be used for example to transport large and/or heavy objects.

On the guides 10-11 and/or on the partitions 13 are also provided suspension means which are not represented in the figures.

Figure 6:
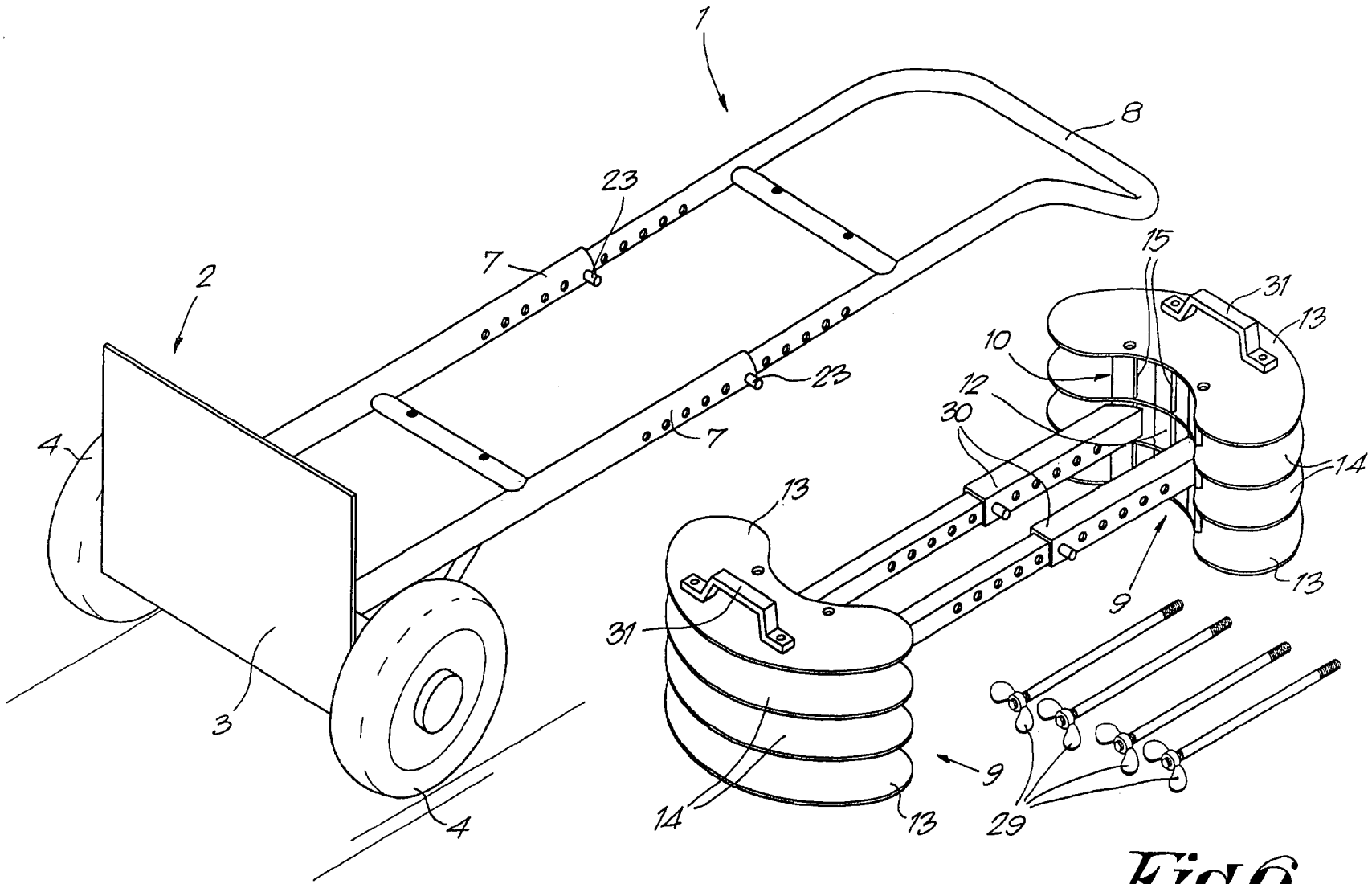
FIG. 6 represents the use of a device 5 according to FIG. 5.

Such an embodiment of a device 1 according to the invention makes it possible to remove the whole of the rods 30 and the guides 10-11 from the support 6, as represented in FIG. 6, and to hang them for example on a wall or the like by means of the above-mentioned suspension means.

If required, the whole can also be stacked, such that space can be saved when storing hoses, cables or the like.

If necessary, the above-mentioned suspension means can also be made such that they can also be used to fix the rods 30 and the guides 10-11 as a whole on the support 6, such that they can be removed and placed back.

Figure 7:
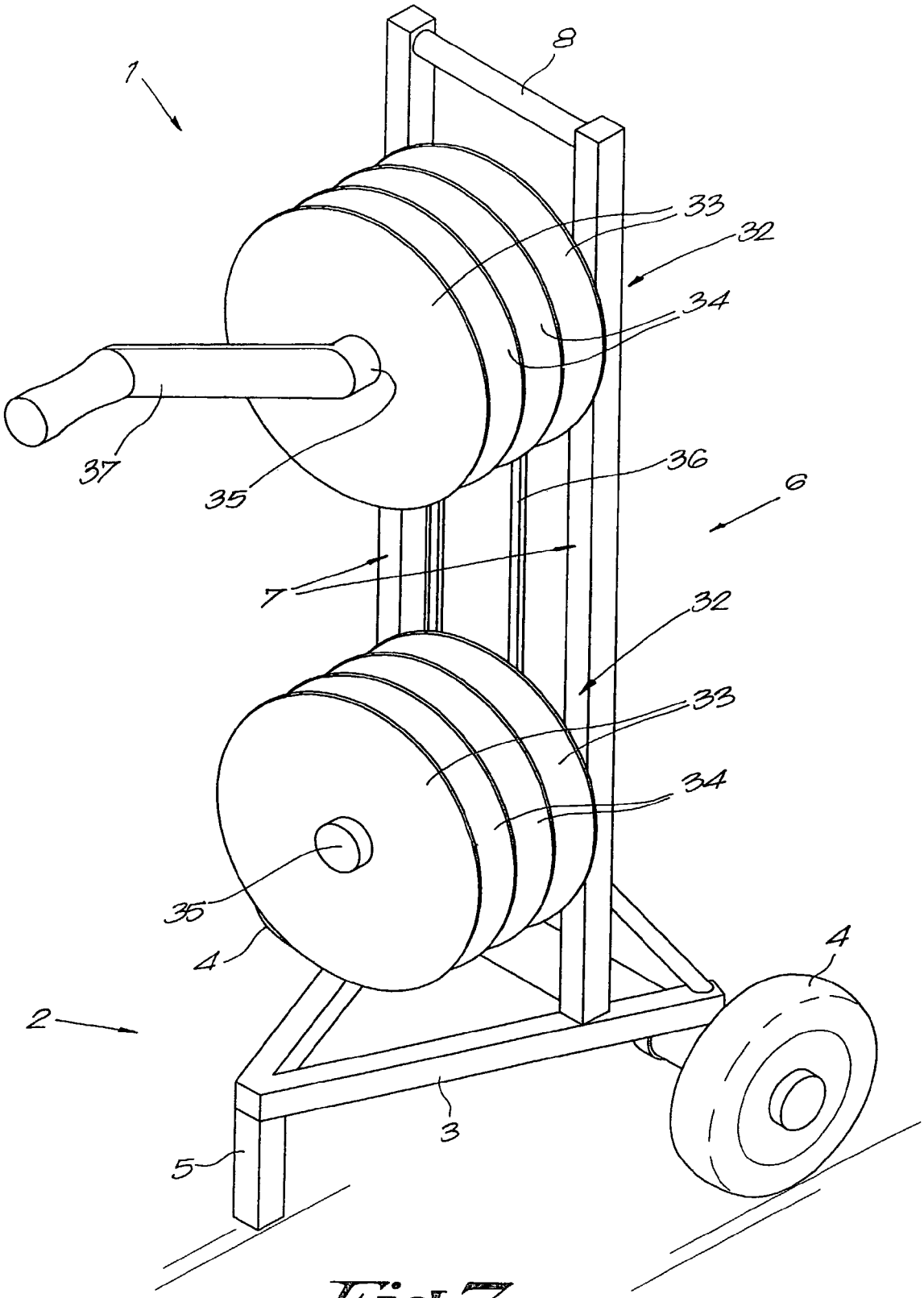
FIG. 7 represents another embodiment of a device according to the invention according to FIG. 1.

FIG. 7 represents another embodiment of a device 1 according to the invention whereby the above-mentioned guides are made in the shape of wide rotatable wheels 32 which are confined by partitions 33 and which are also provided with intermediate partitions 34 which may be provided on the wheels 32, if necessary, in such a manner that they can be removed and placed back.

The above-mentioned wheels 32 are in this case provided on the support 6 such that they can each rotate around a shaft 35, and they are connected to each other for example by means of a belt 36, a chain or the like.

On at least one of the above-mentioned wheels 32 is in this case provided a crank 37 which makes the winding and unwinding of a hose 16 or the like considerably easier.

According to a variant of a device according to the invention as depicted in FIG. 5, the whole of the rods 30 and the guides 10-11 can be provided on the device 1 in a rotatable manner by means of a shaft placed on the above-mentioned support 6, preferably in the middle between the rods, such that, when winding and unwinding a hose, cable or the like, these guides can be wound around the above-mentioned shaft, which establishes an axis of rotation, such that the operation of winding and unwinding is made easier. Any fastening means for fixing the rods 30 and guides 10-11 as a whole on the support 6 would be omitted in this case.

It is clear that the wheels 4 can be provided with pneumatic tyres as well as with full tyres.

It is also clear that means can be provided for tying up the windings of the hose or the like which is wound on a device according to the invention, such that when moving the device, the hose is prevented from coming off, getting entangled or the like.

Naturally, one or several of the above-mentioned guides 10-11 can be provided on the support 6 such that they can be adjusted in height.

It is not excluded, according to the invention, for the above-mentioned support 6 to be adjustable in different angles in relation to the wheeled undercarriage 2.

A device 1 according to the invention can also be made in the shape of a do-it-yourself package.

It is also possible, according to the invention, to provide a storage box on the device 1, which can be either or not removed and placed back, for storing tools or the like.

The present invention is by no means restricted to the embodiments given as an example and represented in the accompanying drawings; on the contrary, such a device 1 for winding and unwinding hoses 16, cables and the like according to the invention, can be made in all sorts of shapes and dimensions while still remaining within the scope of the invention.

The invention claimed is:

1. A device for winding and unwinding elongated flexible material such as hoses and cables, comprising an elongated carrier having wheels mounted thereon to enable wheeled transport of the carrier; an elongated frame detachably and rotatably mounted on the carrier; a winding and suspension assembly in the form of at least two guides mounted in longitudinally spaced relationship on the frame; each guide comprising a convex curved bottom side extending outwardly from and transversely of the frame length, so that the convex curvatures of the bottom sides of the guides face away from each other and towards opposite ends of the frame, and at least one retaining partition element disposed in adjoining relationship with each convex curved bottom side of each guide, each retaining partition element extending perpendicular to the convex curved bottom side of a respective guide so that each guide has at least one retaining partition element associated therewith that forms a retainer for a material wound about the convex curved bottom sides of the guides; said frame mounted to the carrier for rotation about an axis extending transversely to the carrier length and located between the convex bottom sides of the guides.

2. The device according to claim 1, wherein each of said at least two guides comprise a plurality of said guides stacked above one another transversely of the frame length.

3. The device according to claim 2, wherein at least one of said retaining partition elements is removably connected to an associated guide.

4. The device according to claim 1, wherein at least one of said retaining partition elements is removably connected to an associated guide.

5. The device according to claim 1, wherein the frame is adjustable in length to vary the distance between the guides.

6. The device according to claim 1, wherein said at least one retaining partition element comprises at least one end partition element and at least one intermediate partition element associated with each guide, wherein the at least one end partition element is disposed at an outer edge area of the convex curved bottom side of the respective guide, and the at least one intermediate partition element is disposed along the convex curved bottom side of the respective guide, said at least one intermediate partition element dividing the convex bottom side into multiple winding areas; and wherein said at least one intermediate partition element is detachably connected to the respective guide.

7. The device according to claim 1, wherein said guides are detachably mounted on the frame.

8. The device according to claim 1, wherein said wheeled carrier comprises a pair of laterally spaced elongated support elements connected by end elements, said support elements lying in a common plane, said retaining partition elements lying in a plane or planes extending parallel or practically parallel with the plane including said lateral support elements; said axis of rotation extending transversely of said plane including said lateral support elements and between said lateral support elements.

9. The device according to claim 1, wherein recesses are provided in the convex bottom sides of the support elements.

* * * * *

UNITED STATES PATENT AND TRADEMARK OFFICE

CERTIFICATE OF CORRECTION

PATENT NO. : 7,628,350 B2
APPLICATION NO. : 11/579808
DATED : December 8, 2009
INVENTOR(S) : Livin Fernand Georges Dethier It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 337 days.

Signed and Sealed this

Twenty-first Day of December, 2010

David J. Kappos

David J. Kappos
*Director of the United States Patent and Trademark Office*